United States Patent [19]

Seidenbusch

[11] Patent Number: 4,790,778

[45] Date of Patent: Dec. 13, 1988

[54] EQUIPMENT QUICK-CONNECT TERMINAL FOR CONNECTING ELECTRICAL CONDUCTORS TO ELECTRICAL EQUIPMENT

[75] Inventor: Heinz Seidenbusch, Sulzbach-Rosenberg, Fed. Rep. of Germany

[73] Assignee: Siemens Aktiengesellschaft, Berlin and Munich, Fed. Rep. of Germany

[21] Appl. No.: 34,141

[22] Filed: Apr. 2, 1987

[30] Foreign Application Priority Data

Apr. 4, 1986 [DE] Fed. Rep. of Germany ..... 3611366

[51] Int. Cl.[4] ..... H01R 4/36

[52] U.S. Cl. ..... 439/811; 439/709; 439/793; 439/815

[58] Field of Search ..... 439/793, 810–814, 439/709–722, 724, 723, 815

[56] References Cited

U.S. PATENT DOCUMENTS

| | | | |
|---|---|---|---|
| 2,434,604 | 1/1948 | West | 173/269 |
| 3,659,253 | 4/1972 | Weissner | 439/810 |
| 4,269,471 | 5/1981 | Woertz | 439/716 |

FOREIGN PATENT DOCUMENTS

| | | | |
|---|---|---|---|
| 2161882 | 6/1973 | Fed. Rep. of Germany . | |
| 2352432 | 4/1975 | Fed. Rep. of Germany . | |
| 2642262 | 3/1978 | Fed. Rep. of Germany | 439/811 |
| 3417010 | 11/1985 | Fed. Rep. of Germany . | |
| 2234676 | 6/1974 | France . | |

*Primary Examiner*—David Pirlot

*Attorney, Agent, or Firm*—Kenyon & Kenyon

[57] ABSTRACT

A terminal assembly for a quick-connect terminal for connecting electrical conductors to a bus bar of associated electric equipment comprises a conductor frame extending around the bus bar with a thread for a terminal screw surrounded by a U-shaped pressure piece guided in the electrical conductor connecting region by the terminal screw. The terminal assembly is inserted into a longitudinal channel of an insulating cover from the bottom and is snapped into the cover. Two stacked funnels are provided in the cover for insertion of two electrical conductors per terminal assembly. The bus bar of the equipment is inserted into the cover and the terminal assembly transversely to the direction of insertion of the terminal assembly. The cover is secured to the equipment in such a way that it locks the terminal assembly in place within the cover. The insulating cover is so arranged about the electrical conductors and the bus bar of the equipment that the combination is safe from inadvertant human contact with the electrical connections.

5 Claims, 2 Drawing Sheets

EQUIPMENT QUICK-CONNECT TERMINAL FOR CONNECTING ELECTRICAL CONDUCTORS TO ELECTRICAL EQUIPMENT

BACKGROUND OF THE INVENTION

The invention relates to the field of electrical connecting terminals generally and, more particularly, to a terminal for electrical conductors adapted to be quickly connectable to associated electrical equipment.

In the field of electrical equipment design, there has always been a problem of adapting the equipment in such a manner that it may be safely, quickly and semi-permanently connected to an electric power distribution network. With equipment requiring relatively small amounts of power, power cords equipped with plugs for connection via jacks to an electrical network suffices. However, as the power requirements of electric equipment increase so does the complexity of providing a safe, quickly connectable termination for electrical conductors conducting current to the electrical equipment.

An electric conductor terminal having a U-shaped pressure piece tightenable about the conductor by means of a screw is known from German Offenlegungsschrift No. 2 161 882. A power bus bar of electrical equipment to be connected is provided via an insulator with an assembly leg for connection to a supporting bar. The terminal is secured to the bus bar by a spring tab of the terminal and engages a corresponding detent recess of an electrical current bridge.

Furthermore, a terminal screw and a U-shaped pressure piece guidingly disposed inside the terminal are designed together such that the U-shaped pressure piece pinches the detented electrical current bridge and further holds the bridge when the terminal screw is tightened. While such an arrangement provides one arrangement whereby an electrical conductor is both secured and pinched in place in a relatively quick, yet semi-permanent manner, there is no suggestion of a quick, efficient means for both connecting the terminal to an item of electrical equipment as well as to an electrical distribution network. Also, there is no provision for multi-conductor connection. Perhaps most importantly, from a safety standpoint, the known device permits human exposure to exposed electrical conductors.

Consequently, there is a need in the art to provide a terminal which can be connected in a simple manner and is protected against human external contact, especially finger contact.

SUMMARY OF THE INVENTION

The problems and related problems of prior art electrical terminals are overcome by the principles of the present electrical equipment quick-connect terminal. The present invention comprises a cover having a longitudinal channel formed in the cover and open at one end into which a snap-in terminal is inserted. The quick-connect terminal thus assembled can in turn be a snap-in connected to electrical equipment. The snap-in terminal comprises a frame for the electrical conductors which are secured by means of a U-shaped screw-in pressure plate. The cover includes a number of insertion funnels for the electrical conductors which are insulated against human finger contact. An electrical bus bar of electrical equipment can be inserted into the cover and the frame in a direction that is transverse to the direction of insertion of the snap-in terminal. To make it possible to connect several conductor terminals as a unit to electrical equipment, the cover is equipped with several insertion chambers for the snap-in terminals. The quick-connect terminal unit can be in turn snapped-in to electrical equipment having the bus bars as terminals. In order to prevent the unit from loosening from the equipment during operation, detent arms lockingly engage the frame unit and the equipment. At the same time, these detent arms permanently prevent other detent arms that secure the snap-in terminal within the cover from releasing. The detent arms for securing the terminal unit to the equipment are most conveniently located between two adjacent plug-in chambers for the electrical conductors and act transversely to the detent of the terminals. It is this transverse orientation of the separate detent devices that permits the semi-permanent blocking of the release position of the detent arms for the snap-in terminals. Several stacked electrical conductors can be brought into connection with the terminal unit in a simple manner. For this purpose, the terminal is equipped between the upper-most insertion funnel and the head of the terminal screw of the U-shaped pressure piece with a means in the cover holding the U-shaped pressure piece in an open, elevated position. So that only one electrical conductor can be clamped, for instance, into the upper of the two insertion funnels, the holding means is accomplished by widening a lower portion of the U-shaped pressure piece in cooperation with narrowing the upper portion of guiding ribs formed in the side walls of the cover channel.

DETAILED DESCRIPTION

Figure 1:
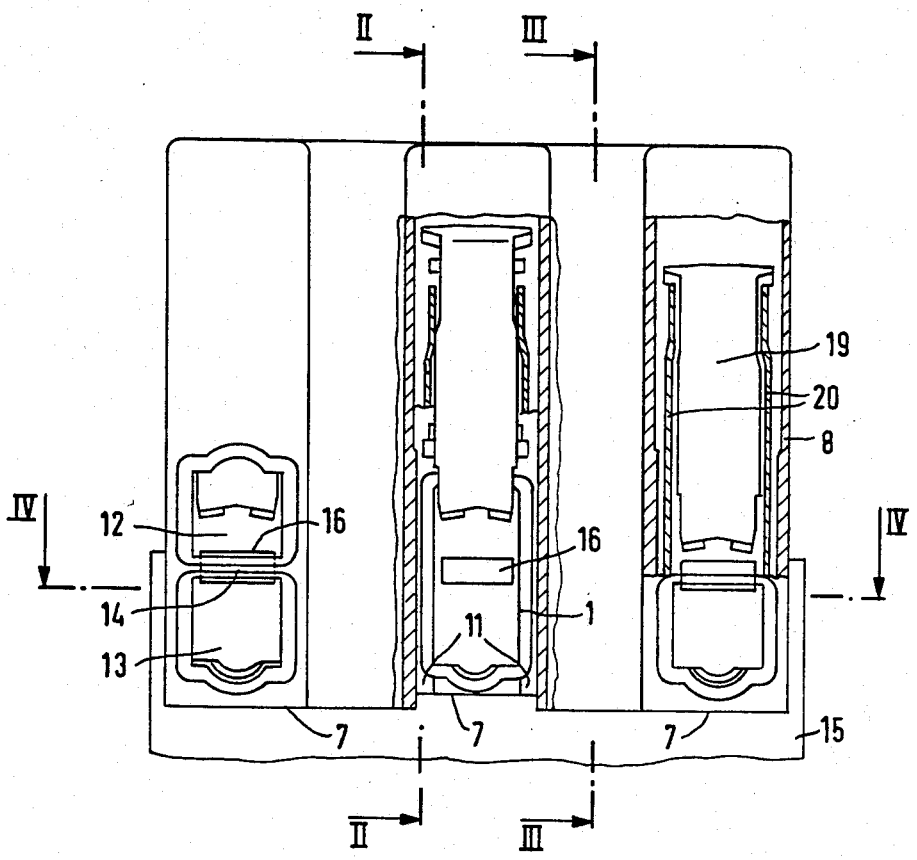
FIG. 1 is a front view onto a unit consisting of an electrical equipment terminal unit comprising three frame terminals in accordance with the principles of the present invention, partly in cut-away cross section.

Similar reference characters are used in FIGS. 1–4 to denote the same elements.

Each frame terminal of an electrical equipment quick-connect terminal unit shown in the drawings consists of a conductor frame 1, in which a thread 2 for a connecting terminal screw 3 is provided. A U-shaped pressure piece 4 having two legs connected by a bridge 19 is provided. It further comprises a recess 5 in an upper leg over a head 6 of the terminal screw 3 so that the U-shaped piece 4 is guided alongside the thread 2 of the screw as the terminal screw 3 is screwed into the frame. The frame terminal assembly consisting of the conductor frame 1, the terminal screw 3 and the U-shaped pressure piece 4 is inserted from the bottom of FIG. 1 or FIG. 2 into a respective channel 7 of a cover 8. The walls 9 of the channel 7 flanking the conductor frame 1 are partially slotted so that resilient arms 10 are formed at the lower end of the channel having claw-shaped extensions 11 which engage the bottom of the frame 1. This snap-in engagement prevents the terminal assembly from falling out after it is inserted. For each frame terminal, the cover has two stacked insertion funnels 12, 13 which are separated from each other by a bridge 14.

Figure 2:
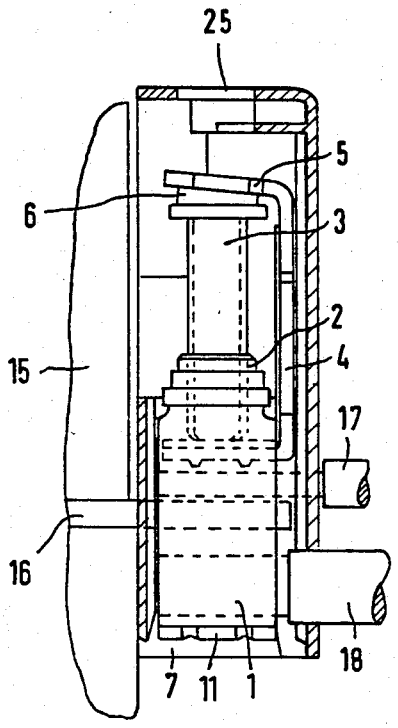
FIG. 2 is a vertical cross sectional view according to the line II—II of FIG. 1.

The bus bar 16 connected to electrical equipment 15 ends behind the bridge 14 so that stacked conductors 17 and 18 shown in FIG. 2 are inserted into the frame through the insertion funnels 12, 13 above and below the bus bar respectively. The U-shaped pressure piece 4 is guided by way of the pressure piece bridge 19 between two guiding ribs 20 formed in the channels 7. The pressure piece bridge 19 is made wider in a central region of the bridge and the spacing of the guiding ribs 20 becomes narrower in an upper region of the ribs so that the U-shaped pressure piece 4 is held in its upward ascent. Consequently, as can be seen from the center terminal position of FIG. 1, as the frame terminal is screwed upwardly, it is squeezed in this region and the terminal cannot move without human intervention if it is opened only for one conductor.

Figure 4:
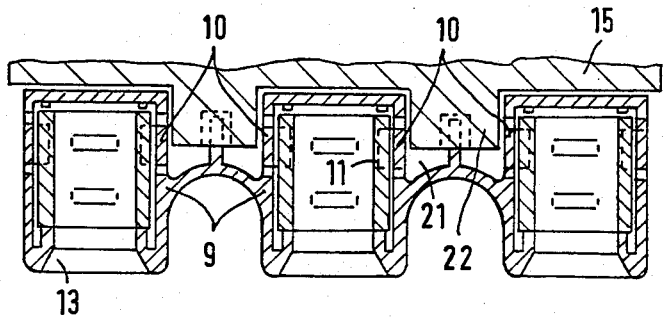
FIG. 4 is a horizontal cross sectional view according to the line IV—IV of FIG. 1.
Figure 3:
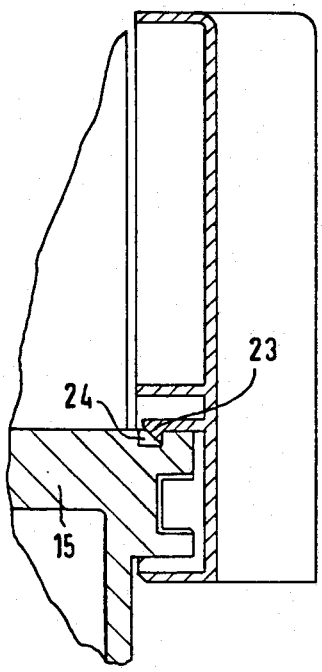
FIG. 3 is a vertical cross sectional view according to the line III—III of FIG. 1.

Referring to FIG. 4, between the two adjacent terminals, the cover has recesses 21 that have an approximately rectangular shaped cross-section, for seating a suitably formed extension 22 of the equipment 15. A detent hook 23 seen in FIG. 3 is formed in the recess 21 and engages a corresponding detent recess 24 in the extension 22 of the equipment 15 which, in combination, serves to hold the cover to the equipment 15. Due to the fact that the extension 22 rests against the walls 9 of the cover and fills the recess 21 also in the region of the previously described resilient arms 10, a releasing of the resilient arms 10 holding the terminal in place is impossible once the cover is fitted on the equipment to be connected. Consequently, it is then impossible to move the conductor frame unit 1 of the snap-in terminal out of the channel 7. The cover is closed by a wall on the side opposite the insertion funnels 12, 13 so that the conductors 17 and 18 can be inserted only up to this wall. For the bus bar 16 of the equipment 15, a corresponding opening is provided in this cover wall through which the bus bar 16 of the equipment may be inserted. On the side of the cover opposite the open end of channel 7, an opening 25 for inserting a screwdriver is provided of such a size that the screw head 6 is protected against contact with human fingers.

Through the illustrated embodiment, a simple mounting for frame terminals with corresponding electrical contact protection is thus provided which is easy to produce, assemble and connect. The present prefabricated quick-connect terminal unit is snapped on to the electrical equipment to be connected and cannot be detached again without auxiliary means.

What is claimed is:

1. A quick-connect terminal for connecting electrical conductors to a bus bar of electrical equipment, comprising:

a cover having a longitudinal channel with an opening at one end, an opening for entry of the equipment bus bar and funnels for entry of the electrical conductors, the longitudinal channel being arranged with respect to the bus bar entry opening such that the direction of bus bar entry is transverse to the longitudinal channel;

a conductor frame terminal assembly comprising a conductor frame extending around the conductors and having a thread for a terminal screw, a U-shaped pressure piece having first and second legs and a bridge connecting the legs, the terminal screw surrounded by the U-shaped pressure piece with the second leg of the pressure piece withing the conductor frame, the terminal screw having a head guiding the first leg of the U-shaped pressure piece, the conductor frame terminal assembly being inserted into the opening of the longitudinal channel of the cover;

means securing the assembly within the longitudinal channel of the cover in a snap-in manner;

the cover has N parallel longitudinal channels, where N is a number greater than or equal to 2, a corresponding number N of terminal assemblies, a corresponding number N of means for securing the N assemblies in the cover and N−1 recesses having an approximately rectangular cross-section and means located at each recess for securing the terminal to the equipment in a snap-in manner, the electrical equipment to be connected further including means for blocking the releasing of the N means securing the N terminal assemblies within the cover when the terminal assembly is connected to the electrical equipment, the N−1 recesses having the approximately rectangular cross section and the means for securing the terminal to the equipment are each located between two adjacent parallel longitudinal channels.

2. The quick-connect terminal according to claim 1, the blocking means of the electrical equipment to be connected comprises N−1 projections, each projection having an approximately rectangular cross section which projections are adapted to be inserted within the N−1 recesses of the cover of the terminal, the projections having a side wall blocking the releasing of one of the N means securing the terminal assembly within the channel of the cover.

3. The quick-connect terminal according to claim 1 wherein two insertion funnels are oriented transversely to the longitudinal channel, stacked on top of each other and separated by a bridge covering the bus bar of the electrical equipment.

4. The quick-connect terminal according to claim 3, the terminal assembly comprises a means holding the U-shaped pressure piece in an open position during opening of the terminal assembly for conductor insertion.

5. The quick-connect terminal according to claim 4 wherein the longitudinal channel comprises guiding ribs on opposite side walls of the longitudinal channel, the holding means comprising in combination a widening of the bridge of the U-shaped pressure piece and a corresponding narrowing of the guiding ribs of the opposite side walls of the longitudinal channel.

* * * * *